US010913293B2

(12) United States Patent
Van Vliembergen et al.

(10) Patent No.: US 10,913,293 B2
(45) Date of Patent: Feb. 9, 2021

(54) SUCTION BLANKET FOR FLAT BED PRINTERS

(71) Applicant: Océ Holding B.V., Venlo (NL)

(72) Inventors: Eduardus J. W. Van Vliembergen, Venlo (NL); Anne A. Wind, Venlo (NL); Robert W. M. Severt, Venlo (NL); Joseph A. Schulkes, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 358 days.

(21) Appl. No.: 15/842,458

(22) Filed: Dec. 14, 2017

(65) Prior Publication Data

US 2018/0178555 A1 Jun. 28, 2018

(30) Foreign Application Priority Data

Dec. 22, 2016 (EP) ..... 16206059

(51) Int. Cl.
*B41J 13/10* (2006.01)
*B41J 11/00* (2006.01)
(Continued)

(52) U.S. Cl.
CPC ..... *B41J 11/0085* (2013.01); *B41J 3/28* (2013.01); *B41J 11/0025* (2013.01);
(Continued)

(58) Field of Classification Search
CPC ..... B41J 3/28; B41J 11/002; B41J 11/0025; B41J 11/0035; B41J 11/0055;
(Continued)

(56) References Cited

U.S. PATENT DOCUMENTS 10,035,361 B2 * 7/2018 Lyon ..... B41J 13/12
2011/0103928 A1 * 5/2011 Holbrook ..... B41J 11/007 414/752.1

(Continued)

FOREIGN PATENT DOCUMENTS

JP 2011201210 * 10/2011 ..... B41J 11/06

OTHER PUBLICATIONS

European Search Report for EP 16 20 6059 completed on Jun. 12, 2017.

*Primary Examiner* — Matthew G Marini
*Assistant Examiner* — Marissa Ferguson-Samreth
(74) *Attorney, Agent, or Firm* — Birch, Stewart, Kolasch & Birch, LLP

(57) ABSTRACT

Method for holding substrates on a flatbed printing system. After positioning the substrates on the substrate support surface, a leak air area not covered by the substrates is covered by positioning a flexible cover device at least over the leak air area, and preferably over the substrates as well. Thereby, air flow through the through-holes is prevented. An under-pressure is then applied to the through-holes, sucking the substrates against the substrate support surface. The flexible cover device is then withdrawn to expose the substrate for printing while the under-pressure is maintained. It was found that despite the additional amount of air passing through the through-holes uncovered by the withdrawal of the flexible cover device, the under-pressure surprisingly remained sufficient to properly hold the substrates for printing. An additional advantage is that the cover device may be applied easily and rapidly over the leak air area and substrates at once.

18 Claims, 6 Drawing Sheets

(51) Int. Cl.
*B41J 29/13* (2006.01)
*B41J 3/28* (2006.01)
*B41J 11/02* (2006.01)

(52) U.S. Cl.
CPC ..... *B41J 11/0035* (2013.01); *B41J 11/02* (2013.01); *B41J 13/10* (2013.01); *B41J 29/13* (2013.01); *B41J 11/0055* (2013.01)

(58) Field of Classification Search
CPC ..... B41J 11/0085; B41J 11/02; B41J 11/06; B41J 13/10; B41J 15/04; B41J 29/13
See application file for complete search history.

(56) References Cited

U.S. PATENT DOCUMENTS

| | | | | |
|---|---|---|---|---|
| 2011/0317144 | A1 | 12/2011 | Baxter | |
| 2016/0236486 | A1 | 8/2016 | Ikeda | |
| 2018/0229517 | A1* | 8/2018 | Cloots | B41J 13/02 |

* cited by examiner

SUCTION BLANKET FOR FLAT BED PRINTERS

FIELD OF THE INVENTION

The present invention generally pertains to a method for holding a substrate on a printing system, a system printing assembly, a cover device assembly, and a cover device.

BACKGROUND ART

Flatbed printing system comprises a relatively large substrate support surface for holding one or more substrates. The substrate support surface is provided with a large number of through-holes for drawing in air. Via the through-holes the substrates are sucked against the substrate support surface. The substrates need to be securely held while printing, as shifting of the substrate results in artifacts in the printed image and to flatten the substrates to prevent contact between the substrate and the image forming unit. The dimensions and number of substrates differs per print job, such that generally a portion of the through-holes in the substrate support surface is not covered by substrates. While one or more substrates may be positioned along a first edge of the substrate support surface, generally the remaining sides of the substrate support surface as well as the regions in between substrates will remain uncovered. To prevent air from leaking into the vacuum table of the printing system and reducing the under-pressure holding down the substrates, these uncovered through-holes are covered up by tape or cut-to-size pieces of cheap or waste print material. Additionally, some substrates are bent preventing them from being properly sucked against the substrate support surface. Such substrates are generally manually pushed flat against the substrate support surface in a separate step. This process is time consuming and costly as it delays the actual printing.

SUMMARY OF THE INVENTION

It is an object of the present invention to provide a time efficient method for printing substrates on a flatbed printing system.

In a first aspect of the present invention, a method for holding a substrate according to claim 1 is provided. The flatbed printing system comprises a substrate support surface provided with a plurality of through-holes. The method comprises the steps of:

- positioning at least one substrate on a substrate area of the substrate support surface, thereby defining a leak air area with through-holes not covered by the at least one substrate;
- positioning a flexible cover device substantially over at least the leak air area to substantially block off air flow through the through-holes in the leak air area; followed by
- applying an under-pressure to the at least one substrate and the cover device via the through-holes; and consecutively
- at least partially withdrawing the cover device from at least the leak air area.

After positioning the one or more substrates on the substrate support surface, one or more sections of the substrate support surface comprising through-holes remain uncovered. These sections with uncovered through-holes form the leak air area. The flexible cover device is then applied to cover the leak area. The cover device may for example be in the form of a sealing blanket, such that it may be applied easily and quickly over the leak air area. Substantially all through-holes are then closed off and an under-pressure may be applied without the risk of drawing in large amounts of ambient air via uncovered through-holes. Thereby, the desired under-pressure for holding the substrates can be quickly acquired. In a subsequent step, the flexible cover device is partially withdrawn, thereby exposing through-holes in the uncovered sections of the leak air area. The flexible cover device is removed from at least part of the leak air area (and optionally at least part of the substrates), such that the substrate are uncovered and accessible to an image forming unit for printing an image on the substrates. The under-pressure is maintained, such that ambient air is drawn in through the uncovered through-holes.

It is the insight of the inventors that surprisingly, despite the air drawn in via the uncovered through-holes, the under-pressure remains sufficient to properly hold the substrates against the substrate support surface for printing. The inventors found that the under-pressure while printing need not be as large as the under-pressure required for initially drawing the substrates properly against the substrate support surface. This allows the flexible cover device to be withdrawn after the under-pressure has been established. The flexible cover device is withdrawn to at least expose the one or more substrates for printing. The flexible cover device is therein positioned as not to obstruct a movement of the image forming unit as it moves over the substrates. The flexibility of the cover allows it to be gradually or piecewise peeled from the substrate support surface, such that little effort and time is required for performing this step. This results in a very time efficient manner of loading and holding substrates on a printing system. As such, the object of the present invention has been achieved.

More specific optional features of the invention are indicated in the dependent claims.

In a preferred embodiment, the cover device is sufficiently flexible to allow it to be stored in a compact storage state, for example in a rolled or folded form. During loading of the substrates, the cover device then takes up limited space, while the cover device may be rapidly applied from such a storage state.

In an embodiment, the step of withdrawing the cover device comprises withdrawing the cover device to a printing position to allow for printing on the substrates. The substrates are therein free of the cover device. The cover device preferably still covers a section or region of the leak air area. In the cover position the cover device is positioned not to impede the motion of the image forming unit while printing. The cover position may be determined by input of an operator via a user interface or from substrate position information provided in the print job information or by means a sensor for determining the substrate positions on the substrate support surface. Alternatively, the cover device may be wholly withdrawn from the substrate support surface.

In an embodiment, the step of at least partially withdrawing the cover device further comprises at least partially withdrawing the cover device from the leak air area while an under-pressure is applied to the at least one substrate and preferably to the cover device. The cover device is withdrawn to a printing position which allows the image forming unit of the printing system to move over and print on the substrates without interference by the cover device. The cover device is therein preferably withdrawn to up to an imaginary line which divides the substrate support surface in a region or print area wherein all substrates are provided and a region free of substrates. Said imagery line is preferably parallel to a gantry along which the image forming unit is translatable. By allowing the cover device to remain on the substrate surface in the printing position as defined by said imaginary line, the amount of air leaking in through the uncovered through-holes is advantageously reduced as the through-holes is said region remain blocked off.

In a further embodiment, the step of applying an under-pressure comprises activating a suction source to apply an under-pressure to the at least one substrate and the cover device via the through-holes, and the step of at least partially withdrawing the cover device is performed while the suction source applies the under-pressure, e.g. when the suction source is activated. The under-pressure draws the substrates tightly against the substrate support surface to reduce the risk of a substrate coming into contact with the image forming unit, damaging either the substrate or the print heads in the image forming unit. Advantageously, the under-pressure may be maintained while withdrawing the cover device. The flexibility of the cover device allows it to be lifted gradually or piece-wise from the substrate support surface. As such, little force is required to remove the cover device. Additionally, the amount of ambient air leaking into the inner chamber of the printing system also increases gradually allowing the suction source to adapt to it. Thereby, the under-pressure in the inner chamber may be maintained or controlled by the suction source, such that a proper holding down of the substrate is ensured.

In another embodiment, the step of positioning the cover device further comprises positioning the cover device over the at least one substrate or medium. The flexible cover device covers the at least one substrate and conforms to its geometry. Preferably, the flexible cover device is deformable to allow it to conform to the shape of a substrate. This is particularly advantageous when the substrates are slightly bent or curved, such that ambient air is able to flow between the substrate and the substrate support surface to through-holes below the substrate. The cover device is then draped over the curved substrate, forming a circumferential seal around the substrate which seal prevents ambient air from being drawn into through-holes below the substrate. Thereby, a sufficiently large under-pressure may be formed below the substrate to draw the substrate against the substrate support surface. The substrate is thereby positioned flat and in tight contact with the substrate support surface over substantially the whole surface of the substrate.

In a preferred embodiment, the cover device comprises a sealing blanket. The sealing blanket is formed of a material substantially non-permeable to air. Such a material may for example be a fabric, such as a textile, treated or coated to prevent air from passing through the sealing blanket. The cover device may thus be formed as a relatively thin and easy to store cover for the substrate support surface. A sealing blanket formed of a sheet material such as cloth or textile has the additional advantage to easily conform to the shape of a substrate for providing a proper seal around and/or over said substrate.

In another embodiment, the method according to the present invention further comprises the cover device forming a substantially airtight seal over and/or around the at least one substrate. Preferably, the cover device therein fully covers the at least one substrate or its top surface. The sealing is due to the flexibility of the device which deforms at the edge of the substrate.

In an embodiment, the step of positioning the cover device further comprises positioning the cover device over the substantially entire substrate support surface. The cover device therein is dimensioned to simultaneously cover the leak air area and the substrate area. The surface area of the cover device is than at least similar or equal to that of the substrate support surface. In case of a rectangular substrate support surface, the length and width of the cover device may be selected equal or greater than those of the substrate support surface. Covering the entire substrate support area with the cover device has the advantage that the cover device may be positioned without regard or knowledge of the positions of the substrates on the substrate support surface. It will be appreciated that within the scope of the present invention the cover device may comprise multiple cover device elements each arranged to cover a predefined region of the substrate support surface. Together such units are arranged to cover the full substrate support surface. In a preferred embodiment, the cover device comprises a single sealing blanket dimensioned to cover the full substrate support area, as thereby the whole surface of the substrate support surface may be covered in a single movement of the sealing blanket. It will be appreciated that the cover device may be applied manually by an operator or by means of applicator device driven by an actuator, thereby automating the printing process.

In another embodiment, the step of withdrawing the cover device further comprises at least partially peeling the flexible cover from the leak air area by gradually pulling a first section of the cover device over the substrate support surface. The first section is located adjacent a non-covered region of the substrate support surface, such as an edge of the substrate support surface or at a substrate. The first section of the cover device is then lifted away from the substrate support surface, either by the operator or the applicator device. As the surface area of the first section is relatively small, it is easily lifted against the under-pressure holding down the substrates and the cover device. The cover device is then peeled from the substrate surface, wherein the free area of the cover device starting with the first section is gradually or stepwise increased. As the area released per unit time is small, little effort is required for the removal of the cover device. Preferably, the cover device is peeled away from the substrate support surface and any substrates positioned thereon by moving the first section over the substrate support surface, specifically over the cover device. The cover device then folds over itself.

In a preferred embodiment, the printing system comprises a translatable image forming unit. The step of withdrawing the cover device then further comprises withdrawing the cover device outside of a print area. The print area contains at the least one substrate. In consequence, the image forming unit is free to translate over the print area for printing an image on the at least one substrate. The at least one substrate is positioned in the print area. The print area is selected to allow the image forming unit to freely move over the one or more substrates. The cover device is thus withdrawn to a cover area of the substrate support surface, wherein the cover device is positioned away from the substrate. Generally, the image forming unit is mounted on a moveable gantry and printing is performed in consecutive swaths. An image is e.g. printed in adjoining swaths, which swaths are parallel to the width direction of the substrate support surface. The print area and the cover area are preferably divided by an imaginary line parallel to the direction of the printed swaths.

In a further embodiment, the printing system is a flat bed printing system comprising a translatable image forming unit. The method further comprises the step of moving the image forming unit over the substrate area and thereby providing an image on the at least one substrate. As explained above, the present invention is particularly advantageous to flatbed printing systems, as these are arranged to hold multiple substrates and are relatively large in size. It will be appreciated that the present invention may further be applied to any type of printing system having a substrate support surface with vacuum holes facing the above presented problem of securing substrates. As explained, with the cover device withdrawn to the printing position, the image forming unit is free to move over the substrates and apply images thereon. In an embodiment, the applied under-pressure to the at least one substrate is maintained while providing the image on the at least one substrate, and wherein the step of providing an image is followed by removing the under-pressure from the at least one substrate and the cover device. Basically, the suction source is activated after completion of the step of positioning the cover device over the leak air area (and optionally the substrates). The suction source remains in its active state during the subsequent or following steps of withdrawing the cover device and printing the images on the substrates. Thereby, a proper holding on the substrates during printing is achieved as maintaining the suction source in its active state ensures that the substrates remain held flatly down against the substrate support surface.

In a further aspect, the present invention provides a printing system assembly according to claim 8. The printing system assembly comprises:

a flatbed printing system comprising:

- a substrate support surface with a plurality of through-holes therein for applying an under-pressure to at least one substrate positioned in a substrate area for holding the substrate against the substrate support surface, thereby defining a leak air area with through-holes not covered by the at least one substrate;
- an image forming unit arranged to move in a length direction and a width direction of the substrate support surface for providing an image on the at least one substrate on the substrate support surface;

a cover device moveable between:

- a cover position wherein the cover device is positioned over the leak air area to substantially block off air flow through the through-holes in the leak air area and, at least partially, over the at least one substrate; and
- a printing position wherein the at least one substrate is free of the cover device; a suction source for applying an under-pressure to the at least one substrate and the cover device via the through-holes;

wherein the cover device is flexible for at least partially withdrawing the cover device from at least the leak air area into the printing position.

The suction source is arranged to draw in air ambient via the through-holes in the substrate support surface for holding substrates on and against the substrate support surface. When one or more substrates are positioned on the substrate support surface, the regions covered by these substrates form the substrate area. Regions not covered by the substrates form the leak air area, wherein through-holes are in fluid connection to the ambient air. The substrate area and leak air area combined form or equal the substrate support surface.

The cover device is arranged to be positioned in the cover position wherein the cover device substantially covers the leak air area. Thereby, ambient air is prevented from being drawn in through the through-holes in the leak air area. As air leaking in is prevented, the suction source in able to achieve sufficient under-pressure at the through-holes to draw the substrates in a holding engagement against the substrate support surface. With the cover device in the cover position, the suction source is arranged to apply the under-pressure to both the substrates as well as the cover device positioned on the substrate support surface. The cover device's flexibility allows the cover device to at least partially overlap a substrate, such that the cover device forms a seal around the substrate. This is particularly advantageous in case the substrate is curved or bent, as the seal aids in increasing the under-pressure between the substrate and the through-holes beneath it. The curved substrate is then flattened against the substrate support surface by the locally increased under-pressure.

To allow for printing, the cover device is positionable in the printing position, wherein the substrates are not covered by the cover device. The image forming unit is then free to access the substrates and deposit an image thereon. Due to its flexibility the cover device may be applied and withdrawn with little effort and time. Thereby, the object of the present invention is achieved.

In a preferred embodiment, the printing system assembly comprises a controller configured to position the cover device on the cover position and in the printing position. The controller is further arranged to control the suction source to apply the under-pressure when the cover device is in the cover position. Further, the controller is configured for controlling the suction source to apply an under-pressure while the cover device is moved from its cover position to its printing position. This surprisingly ensures that the substrates remain properly held down by the under-pressure. The suction source is further controlled to apply an under-pressure during printing. The under-pressure is preferably maintained until completion of the print job. In an embodiment, the controller is further configured for activating the suction source when the substrate support surface is substantially covered by the at least one substrate and the flexible cover device, and for controlling the suction source to maintain an under-pressure on the at least one substrate while the flexible cover device is being withdrawn.

In a preferred embodiment, the cover device in the cover position covers the leak air area and at least one substrate, preferably the majority or all of the substrates, on the substrate support surface. The cover device may then be easily applied without regard to the positions of the substrates. This further may allow the flexible cover device to conform to the shape of the substrates and form a circumferential seal around a substrate, for example when said substrate is curved.

In an embodiment, the flexible cover device is dimensioned to fit over the substantially entire substrate support surface. The flexible cover device, which may comprise one or more sealing blanket units, has an area at least equal to that of the substrate support surface. Likewise, the dimensions of the cover device at least correspond to those of the substrate support surface. This allows the cover device to cover the full surface area of the substrate support surface. Thereby, without knowledge of the positions of the non-covered through-holes, substantially all through-holes may be covered. Preferably, a single sealing blanket dimensioned to at least fit the substrate support surface is applied to cover the substrate support surface in a single rapid motion.

In a further embodiment, the printing system assembly further comprises an applicator device and an actuator for moving the applicator device with respect to the substrate support surface in a first direction for applying the flexible cover device on the leak air area and the at least one substrate, and in a second direction for at least partially peeling the flexible cover device from the substrate support surface. The actuator may be controlled to move the applicator device over the substrate support surface. The cover device is moved from a storage position away from the substrate support surface onto and over the substrate support surface to cover the through-holes in the leak air area. The applicator device may further be arranged to further position, provide or apply the cover device on one or more of the substrates. The applicator device may thereby apply the cover device without interference by an operator, allowing for unattended and high productivity printing. The actuator preferably is controllable to move the applicator device in a gradual (e.g. continuous or step-wisely adjusted) motion in the second direction for peeling the cover device from the substrate support area. The cover device may thus be withdrawn with little effort. The first and second directions are preferably parallel to the substrate support surface, for example parallel to a length or width direction of the substrate support surface. Preferably, the second direction is opposite the first direction.

In an embodiment, the applicator device is a table-wide applicator device as seen in a direction perpendicular to the direction of movement of the applicator device. Thereby, the cover device may in a single sweep be applied over the full width and/or length of the substrate support surface.

In another embodiment, the flatbed printing system comprises a carriage configured to move or translate over the substrate support surface in two directions perpendicular to one another. The printing system further comprises an actuator for driving the carriage. The carriage is preferably translatable along a support beam extending over a width of the substrate support surface. The beam is then moveable in the length of the substrate support surface, such that the carriage's movement covers the full substrate support surface. Alternatively, the beam may extend in the length direction and move in the width direction. Preferably, the applicator device and the image forming unit are mounted together on the carriage. No additional means for moving the applicator device are then required and a compact system is achieved.

In another embodiment, the cover device comprises a flexible sealing blanket for covering and blocking off through-holes in the substrate support surface. The sealing blanket is non-permeable to air to close off the through-holes over which it is positioned. The sealing blanket is made of a flexible or deformable material which allows the sealing blanket on one hand to be compactly stored, e.g. folded or rolled up, and on the other hand to conform to the shape of a substrate. For example, when the sealing blanket is positioned over a substrate, it is draped around it such that the sealing blanket contacts the substrate support surface along the periphery of the substrate, preferably near or in close vicinity of the substrate.

In an embodiment, the printing system assembly further comprises a supply roller holding the flexible cover device in a storage position, which roller is rotatable for supplying the flexible cover device to the substrate support surface. Thereby, the cover device may be stored in a compact manner while allowing unimpeded access to the substrate support surface for loading the substrates.

In a further aspect, the present invention provides a cover device assembly for use in a printing system according to the present invention. The cover device assembly comprises:

a flexible cover device for blocking off air flow through through-holes in a substrate support surface of a printing system;

an applicator device and an actuator for moving the applicator device with respect to the substrate support surface;

a controller for controlling the actuator to move the applicator device:

in a first direction for applying the flexible cover device over the substrate support surface and any substrates positioned thereon; and in a second direction for at least partially peeling the flexible cover device from the substrate support surface to uncover the substrates for printing.

The cover device assembly operates in the above described manner and may be provided as a separate device installable on existing printing systems. It will be appreciated that the cover device assembly may be provided with its own controller or be controlled by the controller of the printing system.

In a further aspect, the present invention provides a flexible cover device for use in a cover device assembly according to the present invention, comprising:

a sealing blanket dimensioned to cover substantially the entire substrate support surface and flexible for allowing the sealing blanket to be peeled from the substrate support surface while the sealing blanket is held against the substrate support surface by an under-pressure applied via through-holes in the substrate support surface.

The cover device may be configured in the above described manner and be provided as a separate device to existing printing systems.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1:
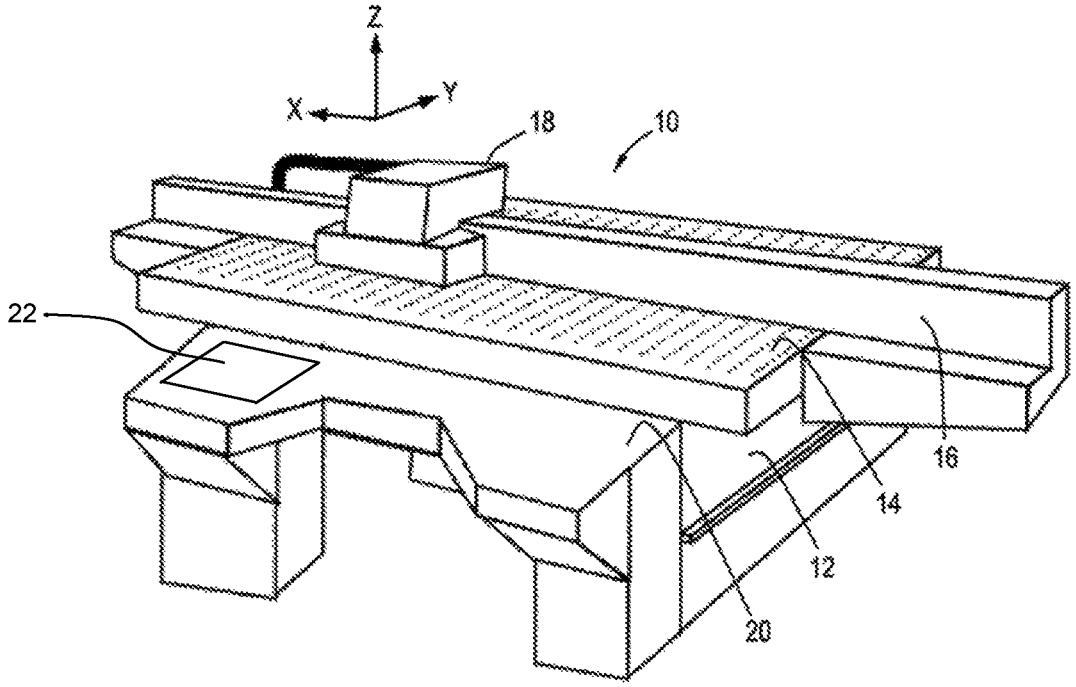
FIG. 1 is a schematic perspective view of a flat bed printing system.

The present invention will now be described with reference to the accompanying drawings, wherein the same reference numerals have been used to identify the same or similar elements throughout the several views.

FIG. 1 illustrates a flat bed printing system 10. The printing system 10 comprises a substrate support surface 14 provided with a plurality of through-holes for applying suction to hold a substrate (S in FIG. 2) against the substrate support surface 14. The through-holes are in fluid connection to a suction source (24 in FIG. 3A) for drawing in air through the through-holes. Thereby, a substrate is sucked against the substrate support surface. In this manner the substrate is held securely in is position while an image is deposited on its top surface by means of an image forming unit 18. The image forming unit 18 comprises one or more print heads for applying ink to the substrate's surface. The image forming unit 18 is arranged to move over and parallel to the substrate support surface 18 in the X and Y directions. In order to avoid contact with the substrate, the distance between the image forming unit 18 and the substrate support surface 14 may be set by moving the image forming unit 18 perpendicularly to the substrate support surface 14 in the Z direction. The image forming unit 18 is provided on a carriage translatable in the X direction along a gantry 16 for printing a swatch on the substrate in the X direction. For positioning the image forming unit 18 in the Y direction, the gantry is translatable in the Y-direction, for example over a guide provided in the side legs 12 of the printing system 10. The printing system further comprises a user interface 20 for inputting print job information to the printing system 10. A controller 22 is provided for controlling the printing process in correspondence with the input print job information.

Figure 2:
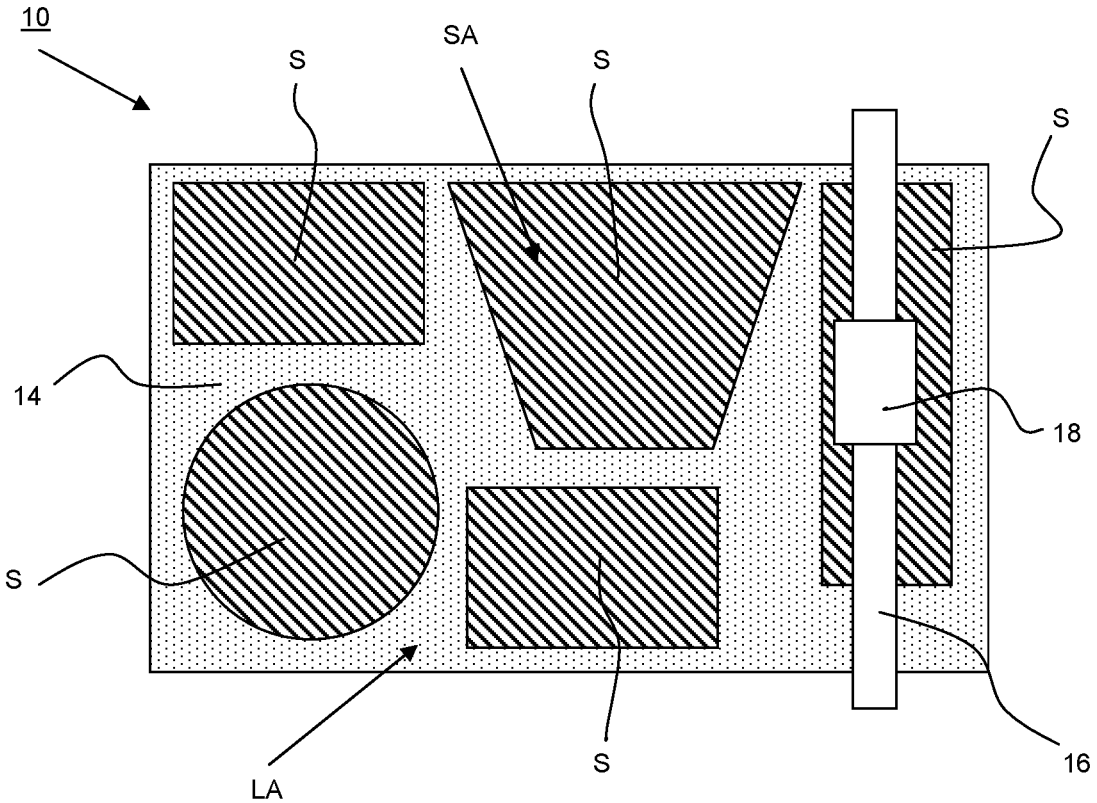
FIG. 2 is a schematic top view of the printing system in FIG. 1 loaded with substrates.

The substrate support surface 14 is generally large, e.g. over 1×1 $m^2$ or more, and arranged to simultaneously hold multiple substrates S, as shown in FIG. 2. Thereby, an operator or loading device may position several substrates on the substrate support surface 14 in a single loading step. These substrates S are then printed in a single pass of the gantry in the Y direction, wherein the image forming unit 18 is iteratively moved in the X direction. This allows for high productivity printing. The dimensions, specifically the shape, size, and/or thickness of the substrates S may vary depending on the desired application of the printed substrates S. Generally, multiple substrates S are positioned together on the substrate support surface 14 to cover as much of the substrate support surface 14 as possible. Areas LA of the substrate support surface 14 not covered by a substrate S are generally closed off prior to printing to achieve sufficient suction to draw the substrates S against the substrate support surface 14. The uncovered area LA may be blocked by means of valves disconnecting said areas LA from the suction source or by covering the areas LA with appropriately dimensioned material, such as tape or remaining print media.

FIG. 2 illustrates a top view of the printing system 10 during after the step of loading the substrates S onto the substrate support surface 14. In consequence of variety in size and shapes of the substrates S, the sum of the surface area SA of the substrates S is less than the area of the substrate support surface 14. Thereby, through-holes not positioned in the substrate area SA, indicated with the dashed pattern, are in fluid connection to the ambient air around the printing system 10. The total area LA of formed by these not covered through-holes forms the leak air area LA through which ambient air may leak into the vacuum table of the printing system 10. This negatively affects the under-pressure for holding down the substrates S. The present invention provides a simple and rapid method for providing sufficient under-pressure to the substrates S.

Figure 3A:
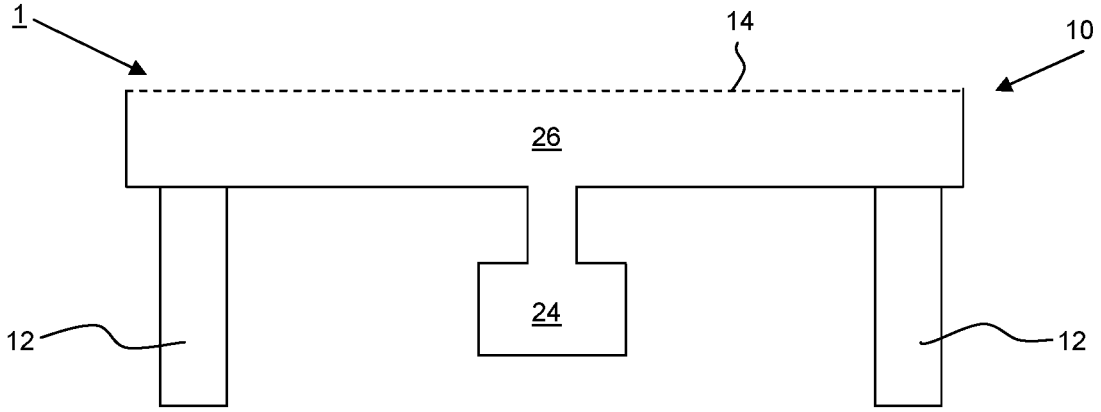
FIG. 3A-F show schematic cross-sectional views of a printing system assembly according to the present invention during various steps of the method according to the present invention.

FIGS. 3A to 3F show various steps of the method for holding a substrate on a printing system 10. FIG. 3A shows the printing system 10 in its initial state prior to performing print job. The substrate support surface 14 comprises a plurality of through-holes extending through the substrate support surface 14 into an inner chamber 26 of the printing system 10. The inner chamber 26 connects the through-holes to the suction source 24. The substrate support surface 14 is relatively large for holding a wide range of substrates S, which may be any type of print media S, ranging from paper or cardboard media to door or wall panels. The number of through-holes in the substrate support surface 14 is very large to properly accommodate this wide variety of different substrate types. It will be appreciated that the through-holes may be provided in any pattern, such as a matrix or regular grid. Further, the inner chamber 26 may in an embodiment be divided into sub-chambers which define suction zones which may be independently of one another be connected and disconnected from the suction source 24. Thereby, suction may be easily applied to common or standard media sizes without air leaking into the vacuum chamber 16 via uncovered through-holes.

Figure 3B:
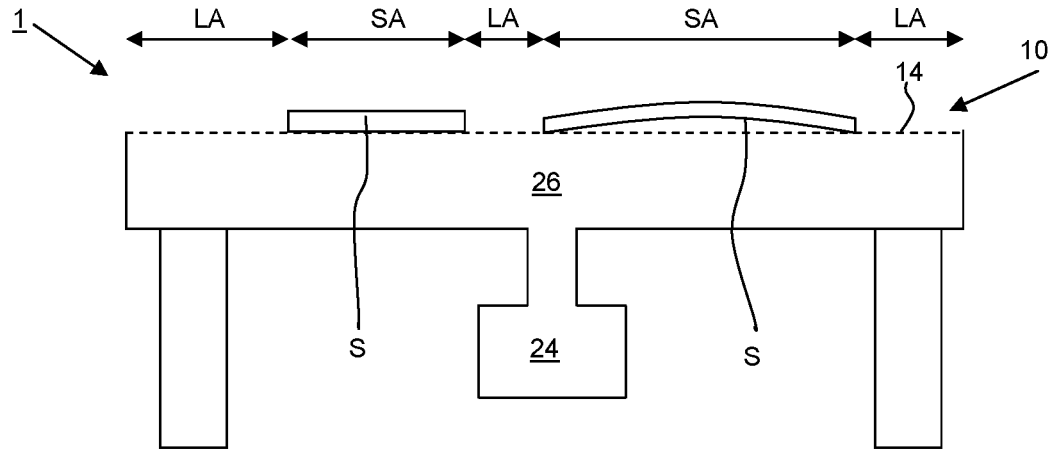

FIG. 3B illustrates the step of positioning or loading the one or more substrates S onto the substrate support surface 14. The arrangement of the substrates S on the substrate support surface 14 is preferably determined prior to loading the substrates S to achieve optimal coverage of the substrate support surface 14 for a print job. The arrangement may be input by the operator via a user interface or determined by the controller 22 from the print job information. Therein, an individual section of the substrate area SA is defined for each substrate S to be positioned on the substrate support surface 14. After loading, as shown in FIG. 3B, the substrate support surface 14 comprises said section of the substrate area SA covered by substrates S, as well as regions of the leak air area LA not covered by a substrate S. The through-holes in the latter areas LA provide a fluid connection to the suction source 24, such that when the suction source 24 is activated air will be drawn in via the uncovered through-holes. This leaking of air into the inner chamber 26, prevents the suction source 24 from establishing sufficient under-pressure in the inner chamber 26 to properly draw the substrates S against the substrate support surface 14. This is particularly disadvantageous when one or more substrates are relatively rigid and curved or bent, as shown in the right substrate S in FIG. 3B. Air is also drawn into the inner chamber 26 through the volume between the bent substrate S and the substrate support surface 14.

Figure 3C:
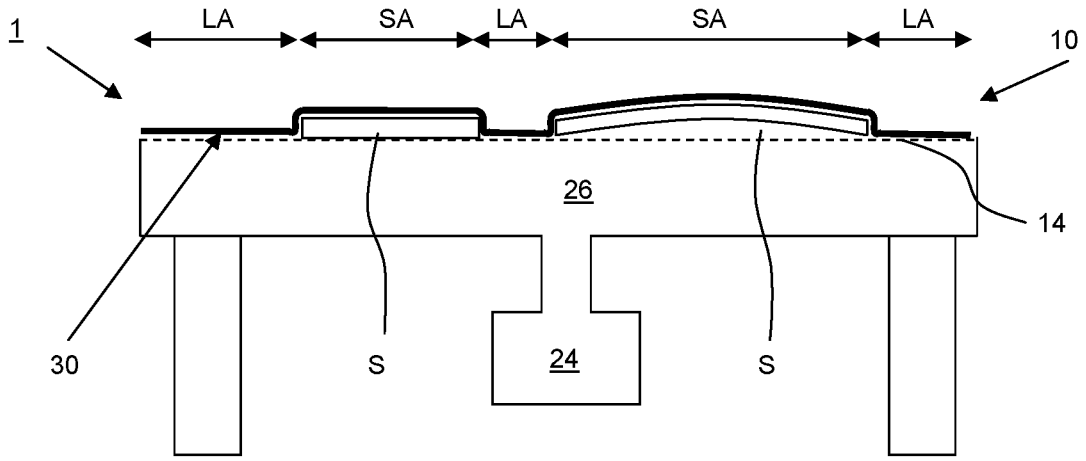

In order to prevent air from leaking into the inner chamber 26, the present invention proposes covering the leak air areas LA as well as the substrate area SA (and therewith the substrates S) with a flexible cover device 30. The cover device 30 which in FIG. 3C is shown as a sealing blanket 30 is formed of a flexible material substantially impermeable to air. In FIG. 3C, the cover device 30 is dimensioned to fit on or cover substantially the full substrate support surface 14. Thus, as the cover device 30 is applied, substantially all through-holes in the substrate support surface 14 will be prevented from drawing in ambient air. The flexibility of the cover device 30 allows it to conform to the shape of the substrate S, thereby effectively forming a seal over and around the substrate S. This is particularly advantageous in the case of the bent substrate on the right in FIG. 3C. The cover device 30 is applied around the curved substrate S such that ambient air is prevented from being sucked into the inner chamber 26 via the volume between the curved substrate S and the substrate support surface 14.

The flexible cover device 30 is preferably formed of a relatively light and/or thin sheet material, making the cover device 30 relatively easy to apply. When a cover device 30 with an area at least equal to that of the substrate support surface 14 is used, the step of positioning the flexible cover device 30 may be performed even more rapidly, as the cover device 30 may applied in a single motion without regard to the exact shapes or positions of the leak air area LA and the substrate area SA. The method according to the present invention is thus much more time-efficient than the prior art method wherein an operator tapes over all leak individual sections of the air area LA.

Figure 3D:
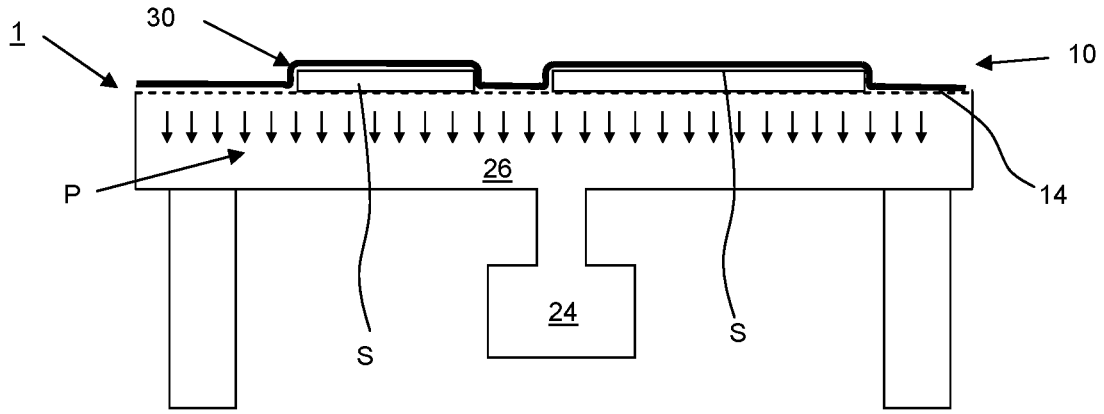

FIG. 3D shows the step of activating the suction source 24 with the cover device present on the printing system 10. The suction system 24 draws all air trapped below the cover device without substantially drawing in ambient air. As the cover device 30 (in combination with the substrates S) seals off substantially all through-holes in the substrate support surface 14, the desired under-pressure in the inner chamber 26 is achieved rapidly. Further, a relatively low power suction source 24 may be applied reducing the costs of the printing system 10. The under-pressure at the through-holes induced a pressure force P on the substrates S, drawing these against the substrate support surface 14. As shown in FIG. 3D, the under-pressure is sufficient to draw the curved substrate S flat against the substrate support surface 14 as the cover device 30 forms a circumferential seal around it. Alternatively, the curved substrate S may be actively pressed down against the substrate support surface 14. In this manner, the desired under-pressure for securely holding the substrates S on the printing system 10 is achieved easily and rapidly.

Figure 3E:
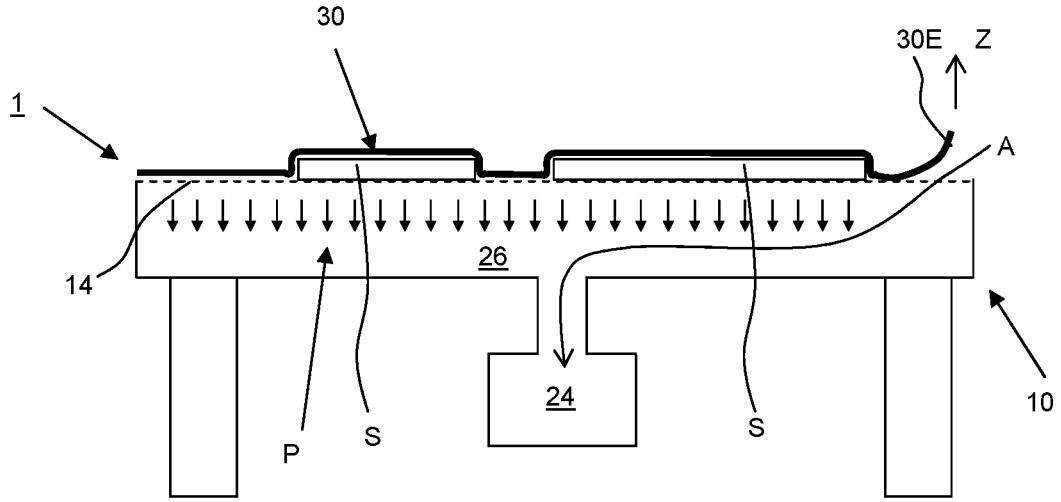

FIG. 3E illustrates the steps of partially withdrawing the cover device 30 from the substrate support surface 14. The withdrawal or removal is performed while the under-pressure is applied to the substrates S and the cover device 30. The suction source 24 is activated. In consequence both the substrates S and the cover device 30 are held or fixed onto the substrate support surface 14. The cover device 30 is initially lifted at a first section 30E, shown as the free end 30E of the cover device 30. This first section 30E is preferably peeled from the substrate support surface 14 as this requires little effort or time despite the under-pressure force P acting on the cover device 30. Peeling in FIG. 3E is illustrated as gradually lifting an increasing section of the cover device 30, starting with the first section 30E, from the substrate support surface 14.

FIG. 3E further illustrates that, during the withdrawal of the cover device 30, ambient air is able to leak into the inner chamber 24 via uncovered regions of the leak air area, shown as air flow A. The inventors found surprisingly that despite the air flow A leaking into the inner chamber 26, the under-pressure remains sufficient to secure the substrates S against the substrate support surface 14 in a manner suitable for printing. It was found that sealing the leak air area was required for initially establishing the under-pressure, but is not required for maintaining the under-pressure after the substrates S have been drawn against the substrate support surface 14.

Figure 3F:
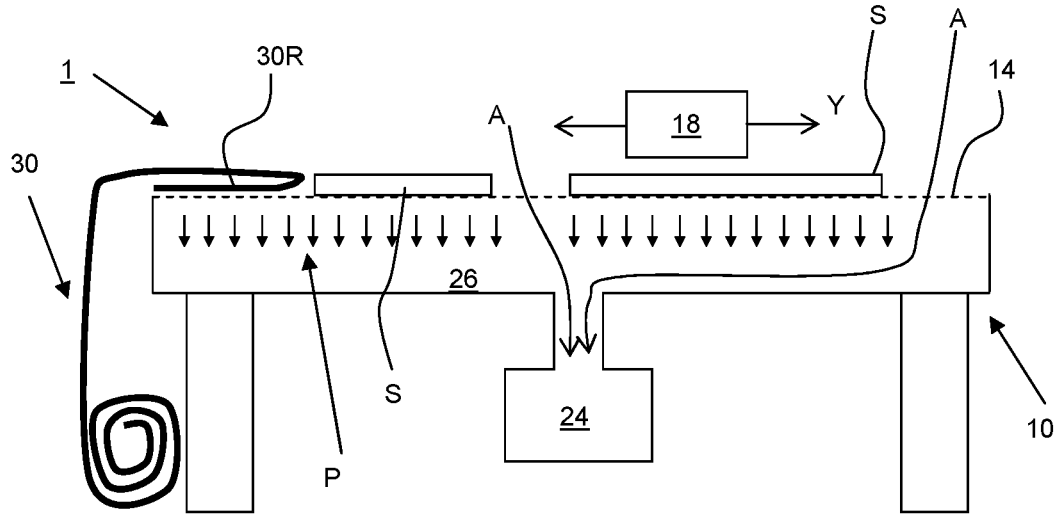

The cover device 30 is preferably folded back over itself such that the substrates S are free of the cover device 30, as shown in FIG. 3E. In FIG. 3E the cover device 30 has been peeled off in the Y direction to uncover the one or more substrates S on the substrate support surface 14. A second section 30R, shown as the remaining section 30R in FIG. 3F remains on a section of the leak air area LA without covering any substrate S. The cover device 30 in FIG. 3F is thus positioned in a printing position, which allows the image forming unit 18 to deposit an image on all the substrates S on the substrate support surface 14 without interference by the cover device 30. The second section 30R reduces the amount of ambient air flow A into the inner chamber 30. As explained above, the under-pressure or the pressure force P despite the ambient air flow A surprisingly is sufficient for fixing the substrates S flatly on the printing system 10 for printing thereon by the image forming unit 18. Upon completion of the print job, the suction source 24 may be de-activated, the substrates S and the second section 30R of the cover device 30 removed from the substrate support surface 14 to allow for the loading of new substrates S for a further print job. Thereby, the present invention provides a fast, cheap, and simple method of positioning substrates S on a flat bed printing system 10. The present invention is particularly advantageous for packaging material such as, carton or cardboard, as these materials tend to curve or bend. Utilizing the cover device 30 in the above presented manner allows for loading of such material onto the printing system 10 without additional measures for removing the curling or bending.

Figure 4:
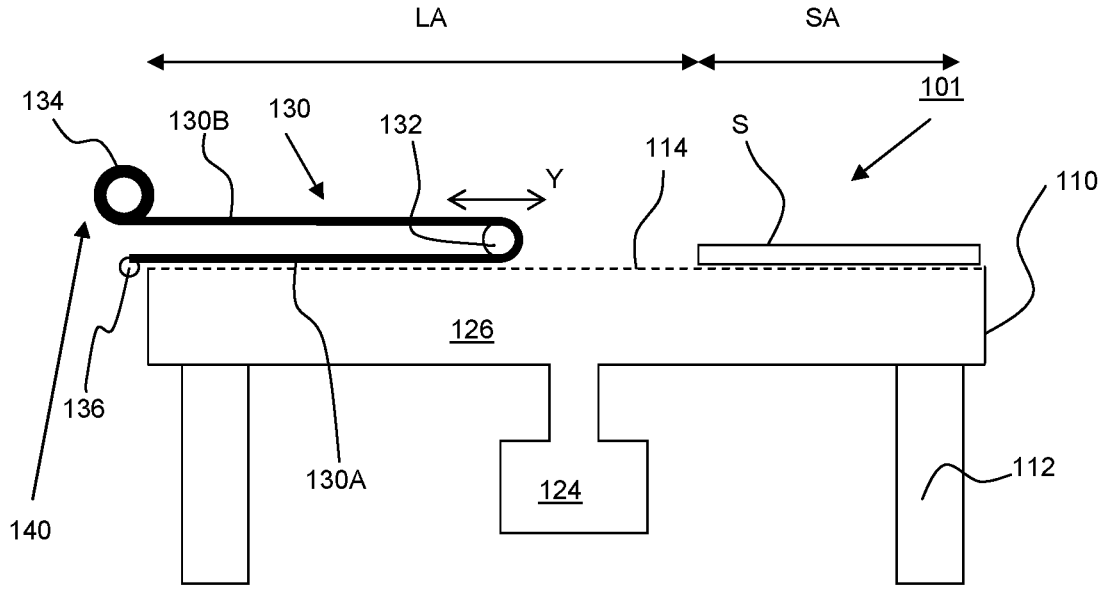
FIG. 4 shows a schematic cross-sectional views of a further embodiment of a printing system assembly according to the present invention.

FIG. 4 shows a further embodiment of the printing system assembly 101 according to the present invention. The printing system 110 is preferably similar to that discussed for FIGS. 1 to 3F and will not be discussed again in detail. The cover device assembly 140 in FIG. 4 comprises the flexible cover device 130 according to the present invention and an applicator device 132 for positioning the flexible cover device 130 over the leak air area LA. The cover device assembly 140 further comprises an actuator for moving the applicator device 132 over the substrate support surface 114. A supply unit 134 in the form of a supply roll 134 is provided for supplying or feeding the flexible cover device 130 onto the substrate support surface 114. It will be appreciated that other forms of supply units 134, such as storage containers or folding units may be applied.

The cover device 130 in FIG. 4 is attached at one end to a holding element 136 positioned adjacent the substrate support surface 114. There from a cover section 130A (the bottom section 130A in FIG. 4) extends at least partially over the substrate support surface 114 for covering and/or blocking off through-holes in the leak air area LA not covered by the substrate S. The applicator device 132 in FIG. 4 is shown as a applicator roller 132. The applicator device 132 and the cover device 130 are preferably table-wide devices 130, 132. The width of the applicator device 132 and the cover device 130 are then at least similar to the width of the substrate support surface 114, measured in a direction X perpendicular to the transport direction Y of the applicator device 132.

The actuator, e.g. an electric linear drive motor or pneumatic cylinder, is arranged to move the applicator device 132 in a transport direction Y over the substrate support surface 114. The applicator device 132 is moveable from a storage position positioned outside or away from the substrate support surface 114 to a cover position positioned over the substrate support surface 114. In the storage position, the substrate support surface 114 is free of the cover device 130 to allow for loading of a new batch of substrates S onto the substrate support surface 114. In the cover position, the cover device 130 covers the leak air area LA not covered by the substrate S. During the step of positioning the cover device 130, the actuator moves the applicator device 132 in the transport direction Y to cover the substrate support surface 114, specifically the leak air area LA, with the cover device 130. The cover device 130 extends from the holding element 136 around the applicator device 132 to the supply unit 134. The cover section 130A between the holding element 136 and the applicator device 132 is in contact with the substrate support surface 114 for blocking off through-holes. A supply section 130B extends between the supply unit 134 and the applicator device 132 over the cover section 130A. The cover device 130 in FIG. 4 thus comprises a U-shaped cross-section curving around the applicator device 132.

As the applicator device 132 moves in the transport direction Y away from the holding element 136 and/or the supply unit 134. The cover device 130 is thereby unwound from the supply unit 134 at roughly twice the speed or rate with which the applicator device 132 moves over the substrate support surface 114. The supply roll 134 is FIG. 4 is preferably pre-tensioned by means of e.g. a spring system, such that when the applicator device 132 moves towards the supply roll 134, the cover device 130 is wound onto the supply roll 134. The pre-tension further aids in spacing the cover section 130A and the supply 130B apart from one another to reduce friction. As such, the cover device may 130 be unwound from the supply unit 134 to cover substantially the entire substrate support surface 114 and any substrate S provided on it.

The embodiment in FIG. 4 is particularly advantageous for unattended printing, especially when combined with a loading device for loading and positioning the substrates S from a substrate supply onto the substrate support surface 114. The controller 22 is arranged to control the actuator to move the applicator device 132 based on the print job. No operator interference is required. In a basic embodiment, the controller 22 is configured to move the applicator device 132 from one side of the substrate support surface 114 before applying the under-pressure and then back when the under-pressure has been applied. In a more advanced embodiment, the controller 22 determines the printing position of the applicator device 132 from the substrate area SA and the leak air area LA. Therein the substrates S are free of the cover device 130 but a region of the substrate surface support surface 114 remains covered by a second section 30R of the cover device 130. The printing position of the applicator device 132 in one embodiment defines the region wherein the gantry 16 moves over the substrates S for printing. Seen in the Y direction, the cover device assembly 130 is then positioned on a side of the gantry wherein no substrates S are present. The gantry 16 is free to move in the region not covered by the cover device 132 without the risk of the two colliding. The controller 22 may further control the activation and de-activation of the suction source 24, respectively after the step of positioning the cover device 130 and after the completion of the printing step. It will be appreciated that the cover device assembly 140 may be applied to a wide variety of different printing systems 110. In one embodiment, the cover device assembly 140 may comprise multiple cover device units each provided with a supply unit and a flexible cover device and provided parallel to one another. Dependent on the width of the printing system 110, the number of cover device units may be adjusted to achieve the desired width. As such various widths may be accommodated while producing one or only a few identical cover device units.

Figure 5:
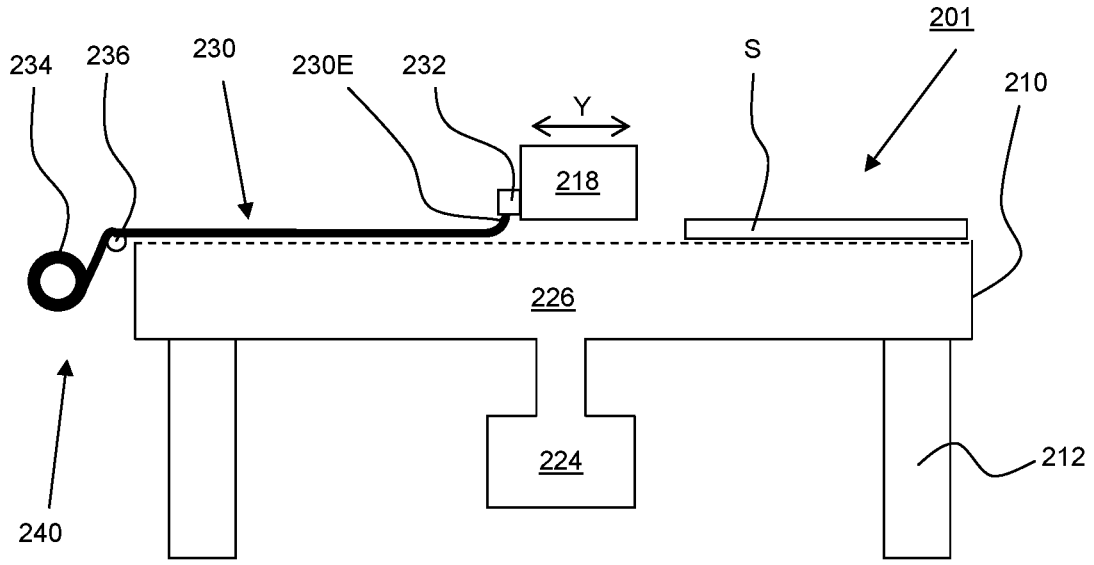
FIG. 5 shows a schematic cross-sectional views of a another embodiment of a printing system assembly according to the present invention.

FIG. 5 shows a further embodiment of the printing system 210 according to the present invention. The applicator device 232 and the image forming unit 218 are provided together on the carriage. By moving the gantry 16 in the Y direction, the applicator device 232 applies or peels away the cover device 230. No additional actuator is then required for moving the applicator device 232. The applicator device 232 in FIG. 5 comprises a holding element 232 for releasably holding the end 230E of the cover device 230. The holding device 232 may be e.g. a suction device or a clamping unit. After loading the substrates S, the applicator devices 232 engages the end 230E and by moving the gantry 16 in the Y direction, the cover device 230 is pulled over the substrate support surface 214. For withdrawing, the gantry 16 is moved in the opposite direction thereby peeling the cover device 230 from the substrate S. Prior to printing the applicator device 232 releases the cover device 230. It will be appreciated that the applicator device 232 in this embodiment may also be configured as the applicator device 132 in FIG. 4.

Figure 6A:
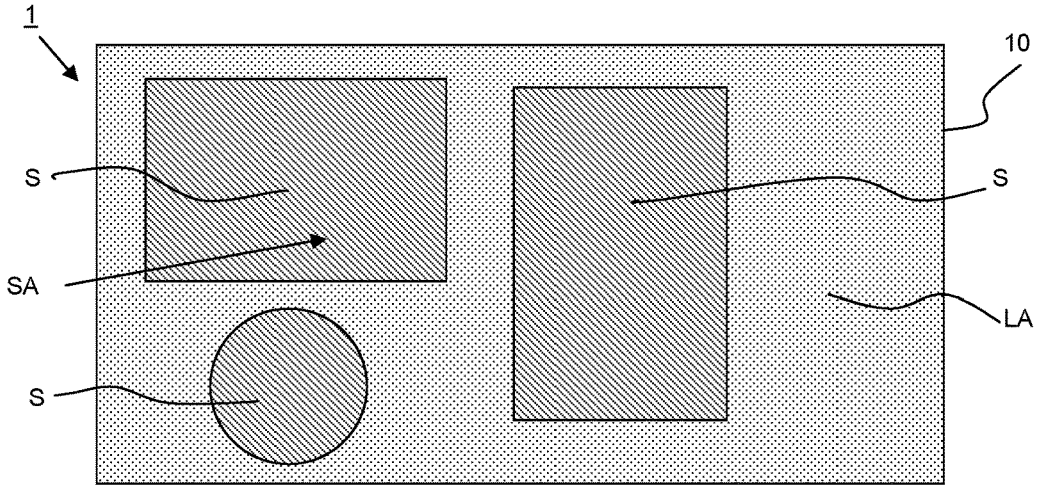
FIG. 6A-C illustrate a flatbed printing system assembly according to the present invention during different steps of the method according to the present invention.
Figure 6B:
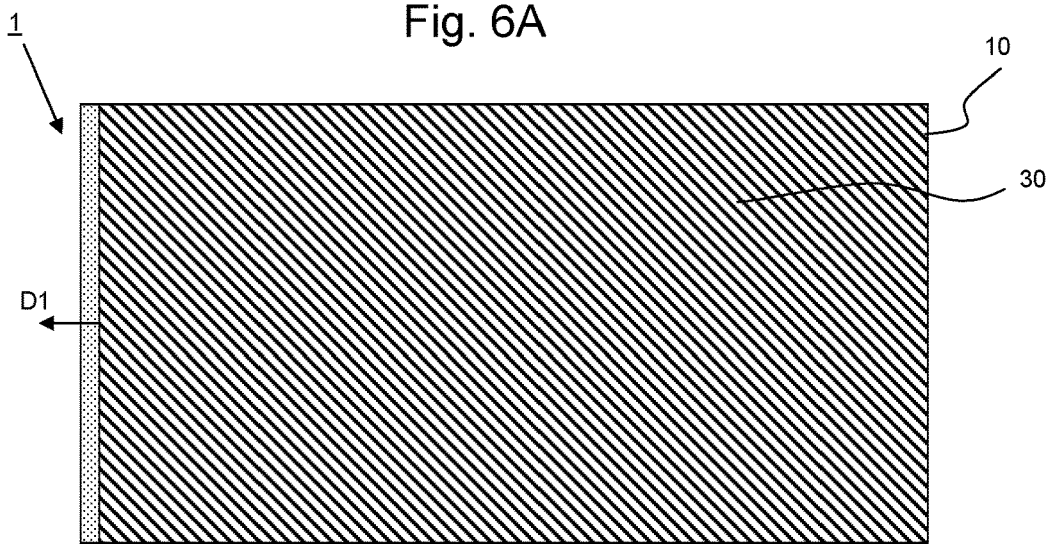
Figure 6C:
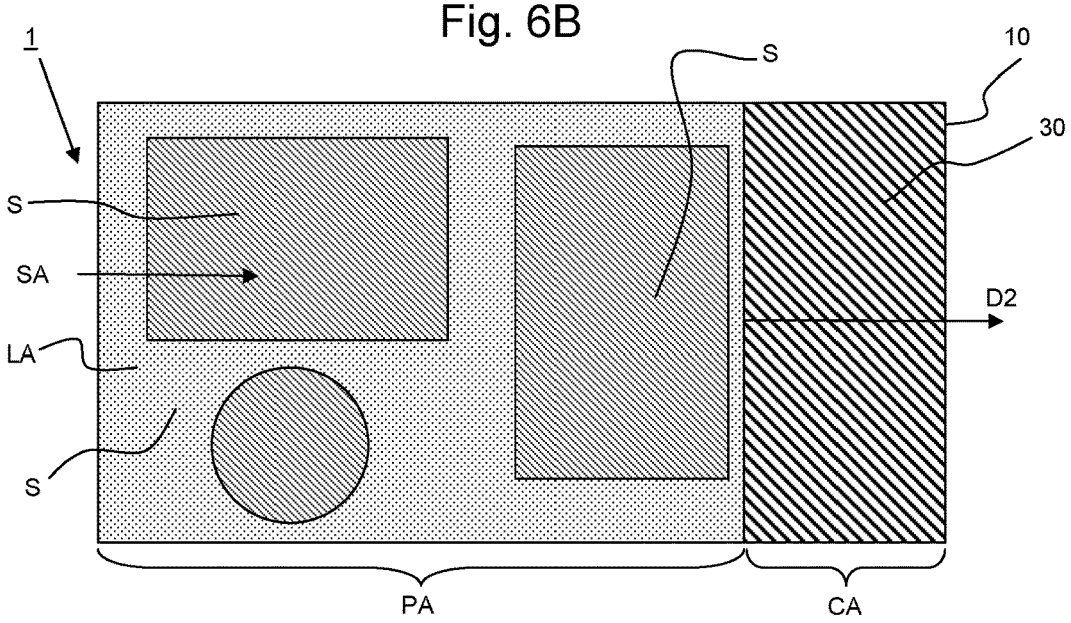

FIG. 6A-C illustrate the steps of an embodiment of the method according to the present invention. The flatbed printing system assembly 1 is shown in top view in FIG. 6A. In FIG. 6A, the substrates S are positioned on a substrate support surface of the printing system 10. The substrate area SA is the collective or total area of the substrate support surface covered by the one or more substrates S. The leak air area LA comprises the through-holes not covered by a substrate S. The leak air area LA is thus the remainder of the substrate support surface not occupied by the substrate area SA. As such, the step of positioning the substrates S divides the substrate support surface into a substrate area SA wherein a substrate S is positioned over through-holes in said substrate area SA and into a leak air area LA in which leak air area LA through-holes are uncovered (i.e. no substrate S is positioned over through-holes in the leak air area LA).

After positioning the substrates S on the printing system 10, the flexible cover device 30 is applied to cover substantially the entire substrate support surface of the printing system 10, as shown in FIG. 6B. Preferably, the cover device is drawn over the substrate support surface in a first direction D1 to at least cover any through-holes not covered by a substrate S. Thereby, the cover device 30 covers at least the leak air area LA. In FIG. 6B, the cover device 30 further covers one or more substrates S. It will be appreciated that the cover device 30 need not cover all substrates S, for example when table-wide substrate S is positioned along an edge of the substrate support surface. It is however advantageous to cover a substrate S with the cover device 30 as it ensures the substrate will be sucked against the substrate support surface, which ensures bent or curved substrates S are properly held against the substrate support surface.

The next step, an under-pressure is applied to both the substrates S and the cover device 30. The flexible cover device 30 forms a seal over the substrate support surface, preventing air from leaking in. Thereby, the substrates S are properly sucked against the substrate support surface.

The following step, the flexible cover device is withdrawn to uncover the substrates S for printing. To that end, the cover device 30 is positioned outside a print area PA, in which the substrates S are positioned. The cover device 30 is positioned such that an image forming unit is able to move freely through the printing area PA to print an image on the substrates S. The print area PA thus includes at least the substrate area SA, but optionally further comprises one or more regions of the leak air area, which regions are positioned in between adjacent substrates S. The cover device 30 is withdrawn outside of the print area PA to a cover area CA, wherein no substrates S are present. When positioned in the cover area CA, the cover device 30 does not impede the movement of the image forming unit through the print area. The cover area CA is preferably part of or positioned in the leak air area LA.

In a consequent step, the image forming unit is moved through the print area PA to print an image on the one or more substrates S.

Figure 7A:
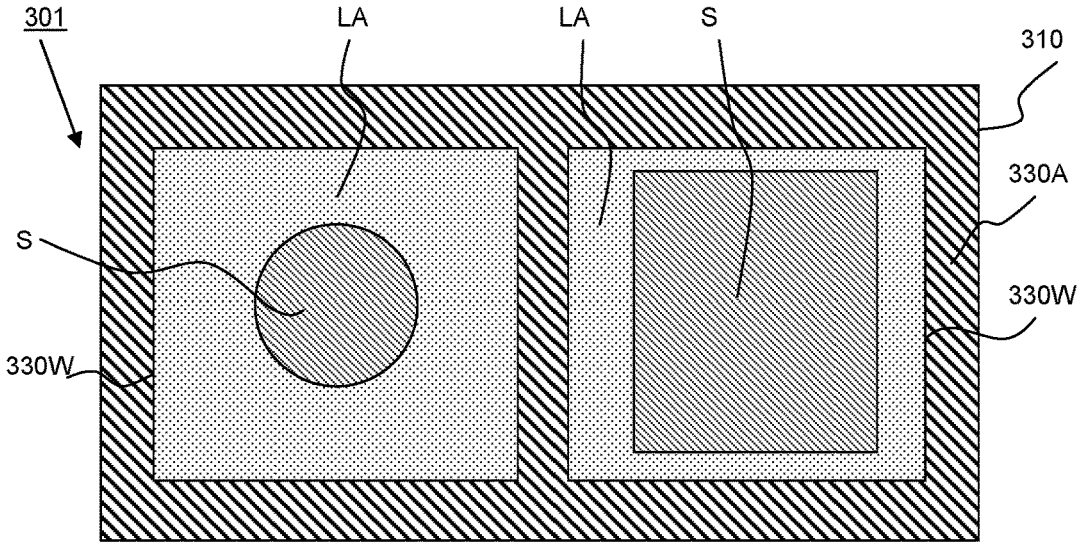
FIG. 7A-C illustrate different steps of positioning an embodiment of a flexible cover device according to the present invention on a flatbed printing system.
Figure 7B:
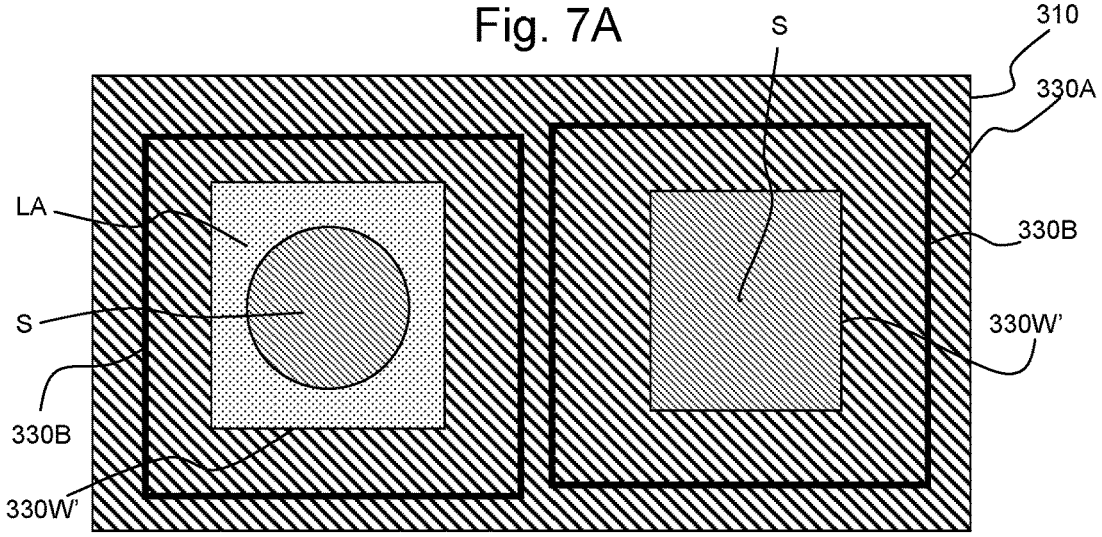
Figure 7C:
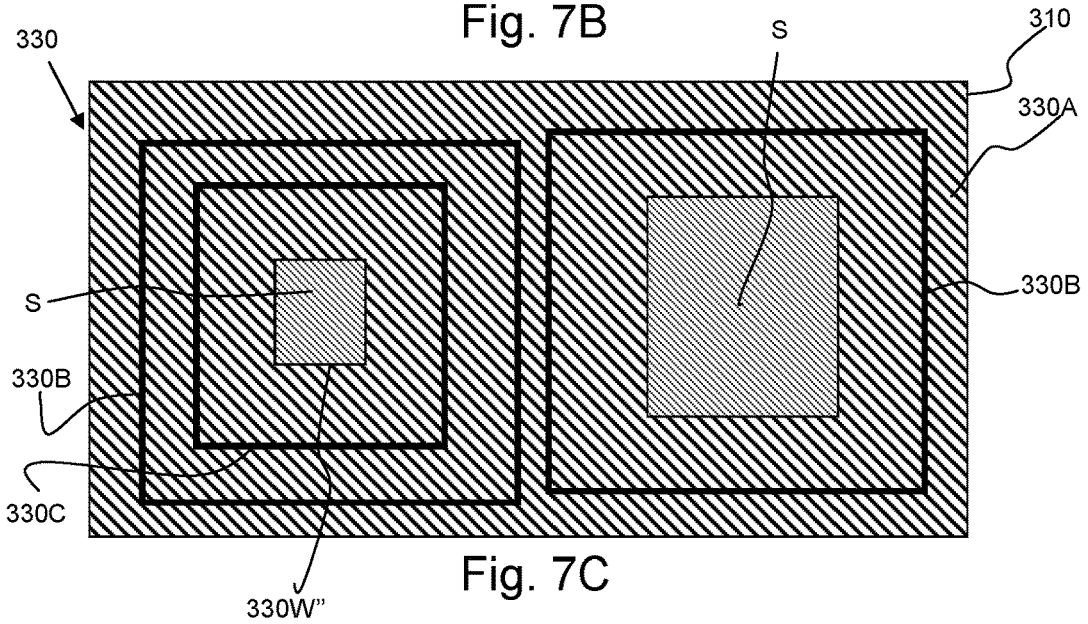

FIGS. 7A-C illustrate different steps of applying a preferred embodiment of a cover device according to the present invention. FIG. 7A illustrates a flatbed printing system 310 as part of assembly 301, whereupon two substrates S are loaded. The cover device 330 comprises a plurality of cover device elements 330A-C, which together are arranged for sealing the through-holes in the leak air area LA of the substrate support surface. In FIG. 7A, a first cover device element 330A has been positioned on the substrate support surface. The first cover device element 330A comprises one or more windows 330W or openings, preferably dimensioned in correspondence to commonly used substrate sizes. The first cover device element 330A in FIG. 7A covers at least the outer edges of the substrate support surface. The substrates S are preferably positioned relative or central to the windows 330W in the first device element 330A. The substrates S in FIG. 7A are smaller than the windows 330W, so that a portion of the through-holes remains uncovered.

In FIG. 7B, a second cover device element 330B is positioned partially over each of the windows 330W of the first cover device section 330A. The cover device 330 comprises a first cover device element 330A with therein at least a first window 330W and a second cover device element 330B comprising a second window 330W' with dimensions smaller than those of the first window 330W. The second cover device element 330B has dimensions smaller than those of the first cover device element 330A and is dimensioned to fit over and cover at least the edges of the first window 330A. When positioning the second cover device element 330B over the first 330A, the second window 330W' is then positioned inside the first window 330W, when seen from above. Thereby, the remaining free area of the substrate support surface can be easily reduced. This is illustrated on the right hand side of FIG. 7B, wherein the window 330W' of the second cover device element 330B falls over the substrate S on the right. Thereby, the leak air area around the substrate S may be quickly and easily covered.

The circular substrate on the left side of FIG. 7B is still surrounded by uncovered through-holes. To cover these a third cover device element 330C is applied, which is arranged to cover at least the edges of the second window 330W' of the second cover device element 330B, such that a third window 330W", with dimensions smaller than those of the second window 330W', is positioned inside the second window 330W', when seen in a top view as in FIG. 7C. The cover device elements 330A-C allow for easy application of the cover device 330. It will be appreciated that in another embodiment the cover device elements may be configured as parallel cover device strips.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printing system assembly, comprising:

a flatbed printing system comprising:

a substrate support surface with a plurality of through-holes therein for applying an under-pressure to a plurality of substrates positioned in a substrate area for holding the plurality of substrates against the substrate support surface, thereby defining a leak air area with through-holes not covered by the plurality of substrates;

an image forming unit arranged to move in a length direction and a width direction of the substrate support surface for providing an image on the plurality of substrates on the substrate support surface;

a cover device moveable between:

a cover position wherein the cover device is positioned over:

the leak air area to substantially block off air flow through the through-holes in the leak air area; and the plurality of substrates to cover entirely or at least a large portion of the plurality of substrates; and a printing position wherein the plurality of substrates is free of the cover device;

a suction source for applying an under-pressure to the plurality of substrates and the cover device via the through-holes;

wherein the cover device is flexible for at least partially withdrawing the cover device from at least the leak air area into the printing position, and wherein the flexible cover device is dimensioned to fit over the entire substrate support surface.

2. A method of using the printing system assembly according to claim 1, the method comprising the steps of:

positioning the plurality of substrates on the substrate area of the substrate support surface, thereby defining the leak air area with through-holes not covered by the plurality of substrates;

positioning the flexible cover device substantially over at least the leak air area to substantially block off air flow through the through-holes in the leak air area; followed by applying the under-pressure to the plurality of substrates and the cover device via the through-holes; and consecutively at least partially withdrawing the cover device from at least the leak air area before the image forming unit providing an image on the plurality of substrates.

3. The method according to claim 2, wherein the step of at least partially withdrawing the cover device further comprises at least partially withdrawing the cover device from the leak air area while an under-pressure is applied to the plurality of substrates and the cover device.

4. The method according to claim 3, wherein:

the step of applying an under-pressure comprises activating a suction source to apply an under-pressure to the plurality of substrates and the cover device via the through-holes; and the step of at least partially withdrawing the cover device is performed while the suction source applies the under-pressure.

5. The method according to claim 2, wherein the step of positioning the flexible cover device further comprises the flexible cover device covering the plurality of substrates, wherein the flexible cover device conforms to a geometry of the plurality of substrates.

6. The method according to claim 2, wherein the step of positioning the cover device further comprises positioning the cover device over the substantially entire substrate support surface.

7. The method according to claim 2, wherein the printing system comprises a translatable image forming unit, and wherein the step of withdrawing the cover device further comprises withdrawing the cover device outside of a print area containing at the least one substrate, such that the image forming unit is free to translate over the print area for printing an image on the plurality of substrates.

8. The method according to claim 7, wherein the applied under-pressure to the plurality of substrates is maintained while providing the image on the plurality of substrates, and wherein the step of providing an image is followed by removing the under-pressure from the plurality of substrates and the cover device.

9. The printing system assembly according to claim 1, further comprising an applicator device and an actuator for moving the applicator device with respect to the substrate support surface:

in a first direction for applying the flexible cover device on the leak air area and the plurality of substrates; and in a second direction for at least partially peeling the flexible cover device from the substrate support surface.

10. The printing system assembly according to claim 9, wherein the applicator device and the image forming unit are mounted on a carriage, wherein the actuator is arranged for moving the carriage in a length as well as in a width direction of the substrate support surface.

11. The printing system assembly according to claim 1, wherein the cover device comprises a flexible sealing blanket for covering and blocking off through-holes in the substrate support surface.

12. The printing system assembly according to claim 1, further comprising a controller configured for:

activating the suction source when the substrate support surface is substantially covered by the plurality of substrates and the flexible cover device;

controlling the suction source to maintain an under-pressure on the plurality of substrates while the flexible cover device is being withdrawn.

13. The printing system assembly according to claim 12, wherein the controller is configured to at least partially withdraw the cover device from the leak air area while an under-pressure is applied to the plurality of substrates and the cover device.

14. The printing system assembly according to claim 12, wherein the controller is configured to withdraw the cover device outside of a print area containing at the least one substrate, such that the image forming unit is free to translate over the print area for printing an image on the plurality of substrates.

15. The printing system assembly according to claim 12, wherein the controller is configured to maintain the applied under-pressure to the plurality of substrates while providing the image on the plurality of substrates, and wherein the controller is further configured to remove the under-pressure from the plurality of substrates and the cover device after providing an image.

16. A cover device assembly for use in a printing system assembly according to claim 1, comprising:

a flexible cover device for blocking off air flow through through-holes in a substrate support surface of a printing system;

an applicator device and an actuator for moving the applicator device with respect to the substrate support surface;

a controller for controlling the actuator to move the applicator device:

in a first direction for applying the flexible cover device over the substrate support surface and any substrates positioned thereon to cover entirely or at least a large portion of the substrates; and in a second direction for at least partially peeling the flexible cover device from the substrate support surface to uncover the substrates before printing.

17. A flexible cover device for use in a printing system assembly according to claim 1, comprising:

a sealing blanket dimensioned to cover substantially the entire substrate support surface and flexible for allowing the sealing blanket to be peeled from the substrate support surface while the sealing blanket is held against the substrate support surface by an under-pressure applied via through-holes in the substrate support surface.

18. The printing system assembly according to claim 1, wherein the flexible cover device conforms to a geometry of the plurality of substrates.

* * * * *